US008862020B2

(12) United States Patent
Noguchi et al.

(10) Patent No.: US 8,862,020 B2
(45) Date of Patent: Oct. 14, 2014

(54) IMAGE FORMING APPARATUS

(71) Applicants: Hidetoshi Noguchi, Tahara (JP); Kazuyoshi Hara, Itami (JP); Takahiro Kuroda, Toyokawa (JP); Satoru Shibuya, Chiryu (JP)

(72) Inventors: Hidetoshi Noguchi, Tahara (JP); Kazuyoshi Hara, Itami (JP); Takahiro Kuroda, Toyokawa (JP); Satoru Shibuya, Chiryu (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 92 days.

(21) Appl. No.: 13/749,051

(22) Filed: Jan. 24, 2013

(65) Prior Publication Data

US 2013/0195528 A1 Aug. 1, 2013

(30) Foreign Application Priority Data

Jan. 31, 2012 (JP) ..... 2012-018408

(51) Int. Cl.
*G03G 15/16* (2006.01)
*G03G 21/00* (2006.01)

(52) U.S. Cl.
CPC ..... *G03G 21/0076* (2013.01); *G03G 21/0047* (2013.01); *G03G 15/161* (2013.01); *G03G 21/0035* (2013.01); *G03G 21/0011* (2013.01)
USPC ..... 399/101; 399/349; 399/353

(58) Field of Classification Search
CPC ..... G03G 21/0076; G03G 21/0035
USPC ..... 399/353, 349, 101; 15/3, 77, 88.3, 182, 15/256.5, 256.52, 256.53, 88.2, 88.4, 15/256.51
See application file for complete search history.

(56) References Cited

U.S. PATENT DOCUMENTS

| | | | | |
|---|---|---|---|---|
| 4,172,303 | A * | 10/1979 | Wooding et al. | 15/256.52 |
| 4,426,751 | A * | 1/1984 | Nordeen | |
| 4,658,708 | A * | 4/1987 | Rastoin | |
| 7,343,133 | B2 * | 3/2008 | Ueno | 399/353 |
| 2005/0079319 | A1 * | 4/2005 | Ohara et al. | |
| 2007/0071525 | A1 * | 3/2007 | Yoshino et al. | 399/353 |
| 2009/0220257 | A1 | 9/2009 | Tsusaka et al. | |
| 2009/0274500 | A1 | 11/2009 | Kimura et al. | |
| 2011/0318060 | A1 | 12/2011 | Yoshida et al. | |

FOREIGN PATENT DOCUMENTS

| | | | |
|---|---|---|---|
| JP | 01-170976 | A | 7/1989 |
| JP | 10-026914 | A | 1/1998 |
| JP | 2001-337542 | A | 7/2001 |
| JP | 2002-278398 | A | 9/2002 |

(Continued)

OTHER PUBLICATIONS

Notification of Reason for Refusal dated Jan. 15, 2014, issued in the corresponding Japanese Patent Application No. 2012-018408, and an English translation thereof. (13 pgs).

*Primary Examiner* — Susan Lee
(74) *Attorney, Agent, or Firm* — Buchanan Ingersoll & Rooney PC

(57) ABSTRACT

Brush rollers rotate in a direction indicated by an arrow while being in contact with an image formation surface to remove toner remaining on the image formation surface from an intermediate transfer belt. The brush rollers each mainly include a rotational shaft and a brush. The brush rollers face the intermediate transfer belt with brush winding directions being opposite from one another. The brush rollers rotate in the direction indicated by the arrow. Thus, seams of the brush rollers can be prevented from being in contact with the same portion on the image formation surface of the intermediate transfer belt.

9 Claims, 6 Drawing Sheets

(56) References Cited

FOREIGN PATENT DOCUMENTS

| | | | |
|---|---|---|---|
| JP | 2003-066803 | A | 3/2003 |
| JP | 2004-325823 | A | 11/2004 |
| JP | 2005-275086 | A | 10/2005 |
| JP | 2006-091554 | A | 4/2006 |
| JP | 2007-057850 | A | 3/2007 |
| JP | 2009-210650 | A | 9/2009 |
| JP | 2009-258541 | A | 11/2009 |
| JP | 2009-271167 | A | 11/2009 |
| JP | 2010-002518 | A | 1/2010 |
| JP | 2010-066508 | A | 3/2010 |
| JP | 2010-072206 | A | 4/2010 |
| JP | 2010-139791 | A | 6/2010 |
| JP | 2012-008398 | A | 1/2012 |

* cited by examiner

IMAGE FORMING APPARATUS

CROSS-REFERENCE TO RELATED APPLICATIONS

The present application claims priority under 35 U.S.C. §119 to Japanese Patent Application No. 2012-018408, filed Jan. 31, 2012. The contents of this application are incorporated herein by reference in their entirety.

BACKGROUND OF THE INVENTION

1. Field of the Invention

The present invention relates to an image forming apparatus including copiers, printers, fax machines, and multi-function machines integrally incorporating copy, printing and fax capabilities.

2. Discussion of the Background

Conventionally, a technique of removing toner with preceding and trailing brush rollers arranged in parallel to the surface of a photoconductor drum has been known (for example, Japanese Unexamined Patent Application Publication No. 2005-275086).

One example of a configuration of a brush roller is described.

The brush roller mainly includes a rotational shaft and a brush wound around the peripheral surface of the rotational shaft. The brush includes a base portion extending in a single direction and a plurality of brush fibers planted in the base portion. The brush roller is formed by helically winding the brush around the outer periphery of the rotational shaft.

There is a following problem in using the brush roller having such a configuration for a long period of time. Specifically, the toner accumulated in the brush is concentrated in a seam of the brush. Thus, the removing performance is lower at the seam of the brush than other portions. As a result, the toner cannot be uniformly removed by the brush roller.

In view of this, an object of the present invention is to provide an image forming apparatus capable of favorably removing toner from an image carrier.

SUMMARY OF THE INVENTION

To solve the problem, an image forming apparatus according to an embodiment of the present invention includes: an image carrier configured to move an image formation surface on which a toner image is formed, along a movement direction; a first brush roller configured to rotate in a rotational direction while being in contact with the image formation surface to remove toner from the image carrier; and a second brush roller disposed in parallel with the first brush roller and configured to rotate in the rotational direction while being in contact with the image formation surface to recover the toner from the image carrier. The first and the second brush rollers each include: a brush formed by planting a plurality of brush fibers in a base portion extending in a single direction; and a rotational shaft having an outer periphery around which the brush is helically wound. The first and the second brush rollers face the image carrier with brush winding directions being opposite from each other.

According to the embodiment of the present invention, the brush extending in a single direction is helically wound around an outer periphery of each of the first and the second brush rollers, and a helical seam is formed between adjacent sections of the brush. The first and the second rollers face the image carrier with the brush winding directions being opposite from each other, and rotate in the same direction.

Thus, the seams of the first and the second brush rollers can be prevented from being in contact with the same portion on the image formation surface of the image carrier. Accordingly, even when one of the first and the second brush rollers cannot ensure a sufficient removing performance in a certain portion of the image formation surface of the image carrier due to the seam, the sufficient removing performance can be ensured by the portion of the other one of the rollers other than the seam. Thus, even when the first and the second brush rollers are used for a long period of time, the attached substances (filming) such as toner can be uniformly removed from the image formation surface of the image carrier, and thus the production of the image noise can be prevented.

In the image forming apparatus, a length of each of the brush fibers may be equal to or longer than 2 mm and equal to or shorter than 6 mm.

Thus, the toner in the brush is uniformly distributed along the axial directions of the first and the second brush rollers. As long as the appropriate amount of the toner is accumulated in the brushes, the brushes can perform uniform removing operations over the entire first and second brush rollers in the axial directions. Thus, excellent cleaning performance can be maintained.

In the image forming apparatus, a winding angle of the brush with respect to the rotational shaft may be equal to or larger than 30 degrees and equal to or smaller than 80 degrees.

Thus, the brush fibers can be prevented from being excessively less densely arranged in the seam between the adjacent sections of the brush than in the other portions, and the adherence of the brush to the rotational shaft can be improved. Thus, the cleaning failure attributable to the seam can be prevented.

In the image forming apparatus, at contact positions between the image carrier and the first and the second brush rollers, the movement direction of the image carrier may be opposite to the rotational direction of the first and the second brush rollers.

Thus, the scraping performances of the first and the second brush rollers can be improved. Accordingly, the cleaning performance can be further improved.

In the image forming apparatus, rotational speeds of the first and the second brush rollers may be the same.

Thus, the toner accumulated in the brush is uniformly distributed along the axial directions of the first and the second brush rollers. Thus, the first and the second brush rollers have the same removing performance. Moreover, with the rotational speeds being the same, the first and the second brush rollers have the same durability. Accordingly, the exchanging timings of the brush rollers can be the same.

In the image forming apparatus, a speed ratio between a rotational speed of a rotator provided in the image carrier and the rotational speed of the first and the second brush rollers may be equal to or larger than 0.5 and equal to or smaller than 3.5.

Thus, the first and the second brush rollers can efficiently remove the toner on the image carrier.

The image forming apparatus may further include a first power source configured to apply a first voltage between the first brush roller and the image carrier to make the first brush roller remove oppositely charged toner; and a second power source configured to apply a second voltage having a polarity opposite from a polarity of the first voltage between the second brush roller and the image carrier to make the second brush roller remove normally charged toner. The first brush roller may be disposed more on an upstream side than the second brush roller in the movement direction.

Thus, the toner (normally charged toner and oppositely charged toner) can be efficiently removed from the image carrier.

The image forming apparatus may further include a lubricant supplier configured to be in contact with an outer periphery of at least one of the first and the second brush rollers to supply a lubricant to the at least one of the first and the second brush rollers.

Thus, the at least one of the first and the second brush rollers serve not only as the brush roller for removing the toner but also as a lubricant applying roller for applying the lubricant on the image carrier.

The image forming apparatus may further include a removing blade disposed more on a downstream side than the first and the second brush rollers in the movement direction, and configured to remove the toner from the image formation surface of the image carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
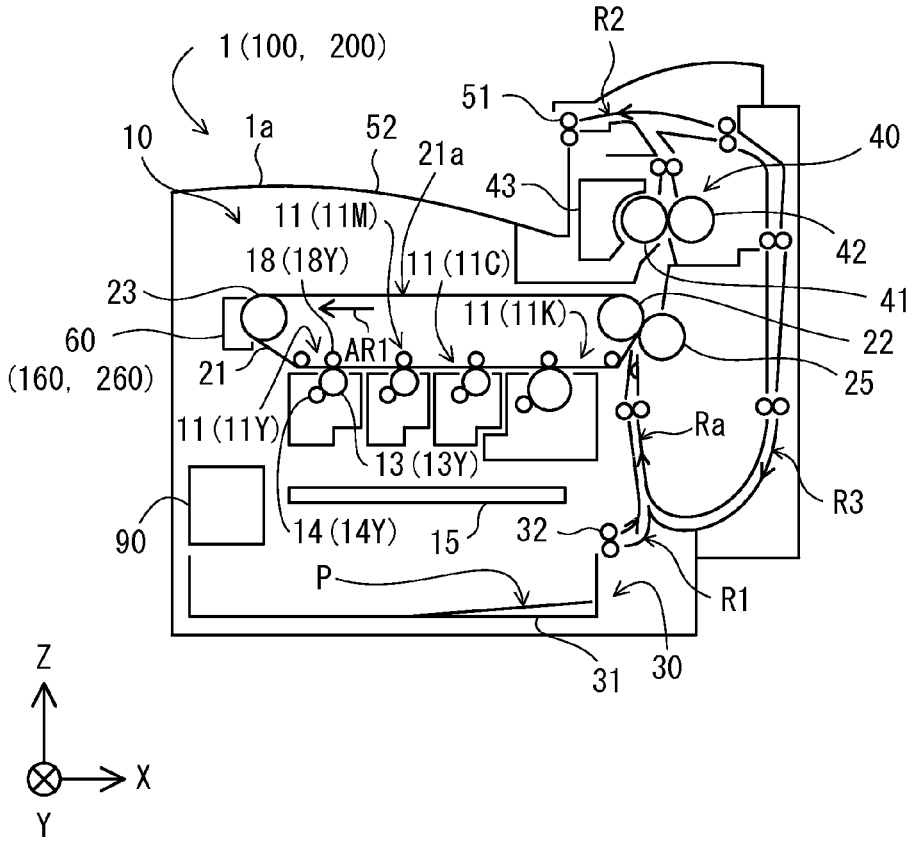
FIG. 1 is a front view showing an example of an overall configuration of an image forming apparatus of first to third embodiments of the present invention.

The embodiments will now be described with reference to the accompanying drawings, wherein like reference numerals designate corresponding or identical elements throughout the various drawings.

1. First Embodiment

1.1. Configuration of Image Forming Apparatus

FIG. 1 is a front view showing an example of an overall configuration of an image forming apparatus 1 of an embodiment of the present invention. The image forming apparatus 1 is used as, for example, a multi-function machine integrally incorporating copy, printing, and fax capabilities, and prints a monochrome image or a color image by electrophotography. As shown in FIG. 1, the image forming apparatus 1 mainly includes a printer unit 10, a sheet feeder 30, a fixing unit 40, a discharge unit 50, and a cleaning unit 60.

FIG. 1 and subsequent drawings are provided, as appropriate, with an XYZ orthogonal coordinate system in which a Z axis direction is a vertical direction and an XY plane is a horizontal plane, to clarify the directional relationship in the drawings. Arrows provided to a sheet feed path R1, a discharge path R2, a circulation path R3, and a conveyance path Ra in FIG. 1 show "conveyance direction of a recording medium P" (hereinafter, also simply referred to as "conveyance direction").

The printer unit 10 forms a monochrome image or a color image on the recording medium P supplied through the sheet feed path R1 and the conveyance path Ra. As shown in FIG. 1, the printer unit 10 mainly includes image forming units 11 (11Y, 11M, 11C, and 11K), a print head 15, and an intermediate transfer belt 21.

The plurality of (4 in this embodiment) image forming units 11 respectively correspond to colors of yellow (Y), magenta (M), cyan (C), and black (K). As shown in FIG. 1, the image forming units 11 (11Y, 11M, 11C, and 11K) respectively mainly include photoreceptor drums 13 (13Y, 13M, 13C, and 13K), developing units 14 (14Y, 14M, 14C, and 14K), and primary transfer rollers 18 (18Y, 18M, 18C, and 18K).

The printer unit 10 of this embodiment is so-called a tandem printer, and below and along the intermediate transfer belt 21, the image forming units 11 (11Y, 11M, 11C, and 11K) are arranged in the order of yellow, magenta, cyan, and black as shown in FIG. 1 for example.

In this embodiment, the image forming units 11Y, 11M, 11C, and 11K have the same hardware configuration. Thus, the image forming unit 11Y, and the photoreceptor drum 13Y, the developing unit 14Y, and the primary transfer roller 18Y as the components of the image forming unit 11Y are described in detail below.

For the convenience of illustration, the reference numerals of the photoreceptor drums 13M, 13C, and 13K, the developing units 14M, 14C, and 14K, and the primary transfer rollers 18M, 18C, and 18K are omitted in FIG. 1 and the subsequent drawings.

The photoreceptor drum 13Y has a cylinder or column shape, and faces the primary transfer roller 18 with the intermediate transfer belt 21 interposed therebetween. The photoreceptor drum 13Y includes a photoconductive film on an outer peripheral surface. The print head 15 is so-called an exposing unit and irradiates the photoreceptor drum 13 (13Y, 13M, 13C, and 13K) with a laser beam.

The outer peripheral surface of the photoreceptor drum 13Y is irradiated with light from the print head 15 so that charges in the irradiated area are removed. Thus, a yellow electrostatic latent image is formed on the outer peripheral surface of the photoreceptor drum 13Y. Similarly, magenta, cyan, and black electrostatic latent images are respectively formed on the outer peripheral surfaces of the photoreceptor drums 13M, 13C, and 13K.

The developing unit 14Y supplies yellow (Y) toner to be transferred onto the intermediate transfer belt 21. Thus, a toner image is formed based on the electrostatic latent image formed on the outer peripheral surface of the photoreceptor drum 13Y. As shown in FIG. 1, the developing unit 14Y is disposed below the intermediate transfer belt 21.

As shown in FIG. 1, the primary transfer roller 18Y faces the photoreceptor drum 13Y with the intermediate transfer belt 21 interposed therebetween. The primary transfer roller 18Y is charged with a polarity that is opposite to that of the outer peripheral surface of the photoreceptor drum 13Y. Thus, when the intermediate transfer belt 21 is nipped by the rolling photoreceptor drum 13Y and the rolling primary transfer roller 18Y, the yellow toner image is transferred onto the intermediate transfer belt 21.

The intermediate transfer belt 21 is an endless belt used as an image carrier. The intermediate transfer belt 21 transfers the toner images of the four colors primary transferred by the image forming units 11 (11Y, 11M, 11C, and 11K), onto the recording medium P. As shown in FIG. 1, the intermediate transfer belt 21 is wound across a driving roller 22, and a driven roller 23 that is made of metal. Thus, an image formation surface 21*a* of the intermediate transfer belt 21 on which the toner image is formed is moved in a direction indicated by an arrow AR1 (hereinafter, also simply referred to as "movement direction"). A secondary transfer roller 25 faces the driving roller 22 with the conveyance path Ra interposed therebetween and contacts the image formation surface of the intermediate transfer belt 21.

Thus, by adjusting the feed timing of the intermediate transfer belt 21 and the conveyance timing of the recording medium P conveyed along the conveyance path Ra, the toner images of the four colors formed on the image formation surface of the intermediate transfer belt 21 are secondary transferred onto the recording medium P.

The sheet feeder 30 feeds the recording media P to the printer unit 10 one at a time. As shown in FIG. 1, the sheet feeder 30 is disposed below the printer unit 10.

The fixing unit 40 fixes the toner images transferred on the recording medium P. As shown in FIG. 1, the fixing unit 40 is disposed more on the downstream side than the secondary transfer roller 25 in the conveyance path Ra. As shown in FIG. 1, the fixing unit 40 mainly includes a fixing roller 41, a pressure roller 42, and an inductive heater 43.

As shown in FIG. 1, the fixing roller 41 and the pressure roller 42 are disposed on both sides on the conveyance path Ra. As the rollers 41 and 42 rotate while the recording medium P is nipped therebetween, the recording medium P is conveyed towards the discharge unit 50.

The induction heater 43 is a high frequency circuit for heating the fixing roller 41 and includes a coil (not shown). The fixing roller 41 is heated as a high frequency alternating current is made to flow through the coil, an eddy current is produced on a surface of the fixing roller 41, and thus Joule heat is produced.

The discharge unit 50 is disposed more on the downstream side than the fixing unit 40 in the conveyance direction, and discharges the recording medium P on which the toner image is fixed to the outside of the apparatus. Specifically, the recording medium P supplied to the discharge unit 50 through the conveyance path Ra is guided to the discharge path R2. As shown in FIG. 1, the discharge unit 50 mainly includes a pair of discharge rollers 51 disposed on the discharge path R2 and a discharge tray 52.

The cleaning unit 60 removes the remaining toner on the intermediate transfer belt 21 after the toner image is transferred onto the recording medium P from the intermediate transfer belt 21. The toner removed from the intermediate transfer belt 21 is stored in the cleaning unit 60. The configuration of the cleaning unit 60 is described later in detail.

A controller 90 controls various components of the image forming apparatus 1 and executes data calculation. For example, the controller 90 receives an image signal from an unillustrated external terminal and the like, converts the image signal into digitalized image data for Y-K color, and controls the operations of the printer unit 10, the sheet feeder 30, and the like. Thus, the printing processing on the recording medium P can be executed.

1.2. Configuration of Cleaning Unit

Figure 2:
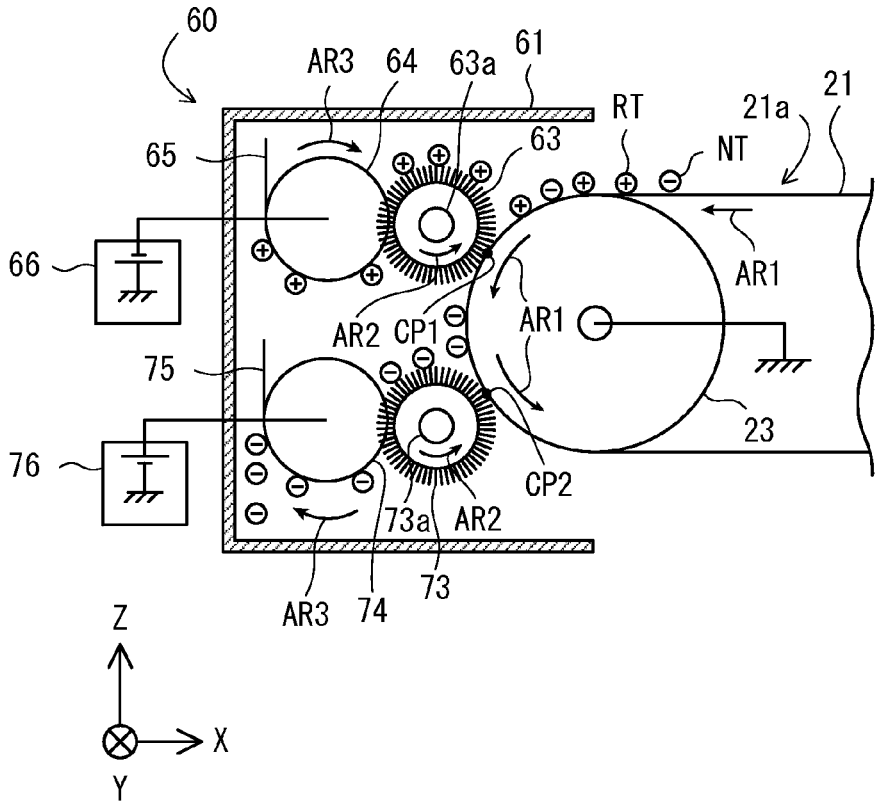
FIG. 2 is a front view showing an example of a configuration of a cleaning unit of the first embodiment.

FIG. 2 is a front view showing an example of the configuration of the cleaning unit 60. The cleaning unit 60 removes toner NT (negatively charged) and toner RT (positively charged) remaining on the intermediate transfer belt 21. The toner RT and the toner NT removed from the intermediate transfer belt 21 are stored in the cleaning unit 60.

As shown in FIG. 2, the cleaning unit 60 mainly includes brush rollers 63 and 73, recovery rollers 64 and 74, and recovery blades 65 and 75, which are incorporated in a frame body 61. The cleaning unit 60 receives power supply from power sources 66 and 76.

In this embodiment, the toner used is negatively charged toner. Thus, the negatively charged toner is also referred to as "normally charged toner" and the positively charged toner is also referred to "oppositely charged toner".

Figure 3:
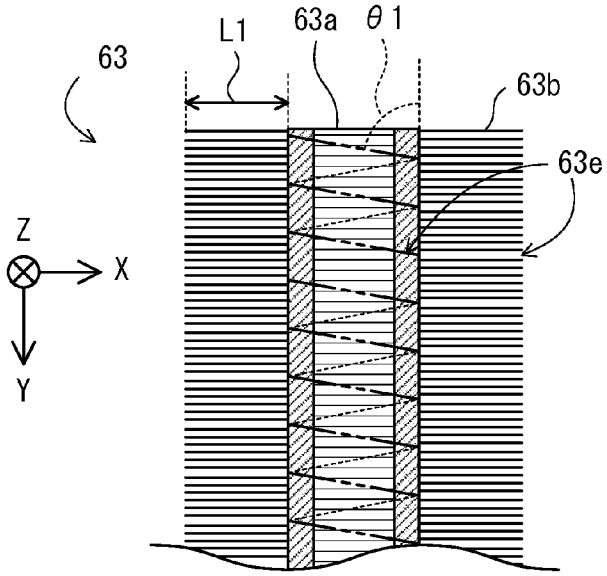
FIG. 3 is a plan view showing an example of a configuration of a brush roller of the first embodiment.
Figure 4:
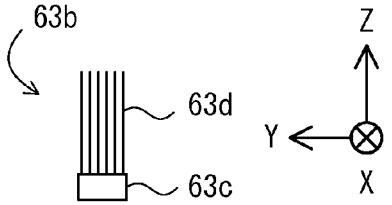
FIG. 4 is a side view showing an example of a configuration of a brush of the brush roller shown in FIG. 3.
Figure 5:
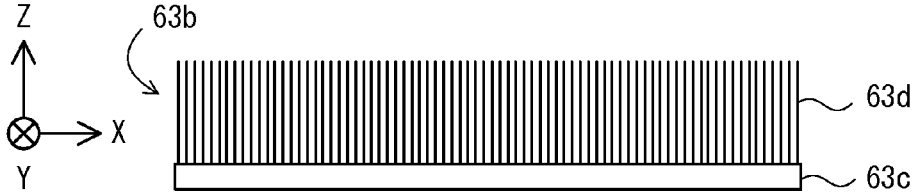
FIG. 5 is a front view showing a configuration of the brush shown in FIG. 4.

FIG. 3 is a plan view showing an example of the configuration of the brush roller 63. FIG. 4 and FIG. 5 are respectively a side view and a front view showing an example of the configuration of a brush 63*b*.

The brush roller 63 (first brush roller) is a conductive rotator that rotates in a direction indicated by an arrow AR2 (hereinafter, also simply referred to as "rotational direction": see FIG. 2) (counterclockwise in FIG. 2) while being in contact with the image formation surface 21*a*. Thus, the brush roller 63 removes from the intermediate transfer belt 21, the oppositely charged toner RT remaining on the image formation surface 21*a* after the toner image is transferred onto the recording medium P.

As shown in FIG. 2, the brush roller 63 is arranged in parallel with the brush roller 73 and more on the upstream side than the brush roller 73 in the movement direction of the intermediate transfer belt 21. As shown in FIG. 3, the brush roller 63 mainly includes a rotational shaft 63*a* and the brush 63*b*.

The rotational shaft 63*a* is a metallic core extending in a single direction. The brush 63*b* before being wound around has a strip shape as shown in FIG. 4 and FIG. 5. As shown in FIG. 3, the brush 63*b* is helically wound around the outer periphery of the rotational shaft 63*a* and is bonded to the rotational shaft 63*a* with a conductive bond. As shown in FIG. 4 and FIG. 5, the brush 63*b* mainly includes a base portion 63*c* and brush fibers 63*d*.

The base portion 63*c* is formed of a conductive base cloth, and as shown in FIG. 5, extends in a single direction (X direction in FIG. 5). The brush fibers 63*d* are conductive fibers (original yarn) planted in the base portion 63*c*.

The recovery roller 64 is a metallic rotator that rotates in a direction indicated by an arrow AR3 (clockwise in FIG. 2). As shown in FIG. 2, the recovery roller 64 faces the intermediate transfer belt 21 with the brush roller 63 interposed therebetween. The recovery roller 64 recovers the oppositely charged tonner RT recovered by the recovery operation of the brush roller 63 from the brush roller 63.

The recovery blade 65 is a metallic plate facing the recovery roller 64. A distal end of the recovery blade 65 is in contact with the recovery roller 64. Thus, the oppositely charged toner RT recovered by the recovery roller 64 is scraped off from the outer peripheral surface of the recovery roller 64 to be removed.

The power source 66 (first power source) applies a bias required for recovering the oppositely charged toner RT. As shown in FIG. 2, the power source 66 has one end grounded and the other end electrically coupled to the recovery roller 64 so as to provide a negative potential to the recovery roller 64. As shown in FIG. 2, the driven roller 23 is grounded, and the intermediate transfer belt 21 is wound therearound. The intermediate transfer belt 21 and the brush roller 63 are in contact with each other at a contact position CP1. The brush roller 63 and the recovery roller 64 are in contact with each other for the recovery of the oppositely charged toner RT.

Accordingly, a negative first voltage is applied between the brush roller 63 and the intermediate transfer belt 21, and thus the oppositely charged toner RT is removed by the brush roller 63. The voltage to be applied by the power source 66 is controlled by the controller 90.

Figure 6:
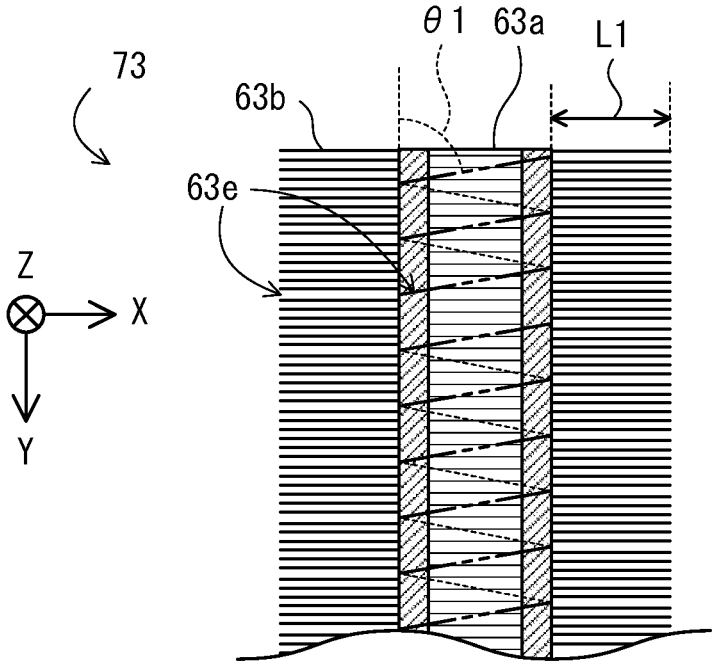
FIG. 6 is a plan view showing an example of a configuration of a brush roller of the first embodiment.

FIG. 6 is a plan view showing an example of the configuration of the brush roller 73. The brush roller 73 (second brush roller) is a rotator having the same hardware configuration as the brush roller 63 except that the brush 63*b* is wound in the direction opposite from that in the brush roller 63. The brush roller 73 mainly includes the rotational shaft 63*a* and the brush 63*b*.

The brush roller 73 rotates in the direction indicated by the arrow AR2 while being in contact with the image formation surface 21*a*. Thus, the brush roller 73 removes from the intermediate transfer belt 21, the normally charged toner NT remaining on the image formation surface 21*a* after the toner image is transferred onto the recording medium P.

As shown in FIG. 3 and FIG. 6, the brushes 63*b* of the brush rollers 63 and 73 are helically wound while inclining symmetrically with each other with respect to the axial direction. In other words, the brush rollers 63 and 73 face the intermediate transfer belt 21 with their brushes 63*b* being wound in the opposite directions. As described above, the brush rollers 63 and 73 are configured to rotate in the same direction (indicated by the arrow AR2).

As shown in FIG. 3 and FIG. 6, when the brushes 63*b* is wound around the rotational shaft 63*a*, a seam 63*e* is formed between adjacent sections of the brushes 63*b* on the outer periphery of the rotational shaft 63*a*. As shown in FIG. 3 and FIG. 6, on the outer periphery of the rotational shaft 63*a*, the brush fibers 63*d* are less densely arranged in the seam 63*e* than in the other portion. Thus, when the brush rollers 63 and 73 are used for a long period of time, the toner accumulated in the brushes 63*b* is concentrated in the seam 63*e*. Thus, the removing performance is lower at the seam 63*e* than other portions.

Thus, when the attached substances (filming) such as the toner RT and the toner NT are removed from the image formation surface 21*a* of the intermediate transfer belt 21 by using any one of the brush rollers 63 and 73, the uniform removing operation along the axial direction of the brush roller 63 or 73 cannot be achieved. As a result, image noise is produced on the toner image formed on the intermediate transfer belt 21.

To address this, the brush rollers 63 and 73 of this embodiment face the intermediate transfer belt 21 and rotate in the same direction (indicated by the arrow AR2) with the winding directions of the brushes 63*b* being opposite from each other, as described above.

Thus, the seams 63*e* of the brush rollers 63 and 73 can be prevented from being in contact with the same portion on the image formation surface 21*a* of the intermediate transfer belt 21. Accordingly, even when one of the brush rollers 63 and 73 cannot ensure a sufficient removing performance in a certain portion of the image formation surface 21*a* of the intermediate transfer belt 21 due to the seam 63*e*, the sufficient removing performance can be ensured by the portion of the other one of the rollers other than the seam 63*e*. Thus, even when the brush rollers 63 and 73 are used for a long period of time, the attached substances can be uniformly removed, and thus the production of the image noise can be prevented.

As described above, the brush rollers 63 and 73 of this embodiment have the same configuration except that the winding directions of the brushes 63*b* with respect to the rotational shaft 63*a* are opposite from each other. Thus, commonization of parts is viable. Accordingly, the costs required for manufacturing and maintaining the image forming apparatus 1 can be reduced.

Moreover, the used conditions (for example, the amount pressed against the intermediate transfer belt 21) can be the same between the brush rollers 63 and 73. Thus, he time for setting the used condition can also be reduced. Thus, the costs for manufacturing and maintaining the image forming apparatus 1 can be reduced while maintaining the removing performance.

In the embodiment, the rotational speeds of the brush rollers 63 and 73 are set to be the same. Thus, the toner RT and the toner NT accumulated in the brushes 63*b* are uniformly distributed along the axial directions of the brush rollers 63 and 73. Thus, the brush rollers 63 and 73 have the same removing performance.

Moreover, with the rotational speeds of the brush rollers 63 and 73 being the same, in the embodiment, the brush rollers 63 and 73 have the same durability. Accordingly, the exchanging timings of the brush rollers 63 and 73 can be the same.

Like the recovery roller 64, the recovery roller 74 is a metallic rotator, and rotates in the direction indicated by the arrow AR3 (clockwise). As shown in FIG. 2, the recovery roller 74 faces the intermediate transfer belt 21 with the brush roller 73 interposed therebetween. The recovery roller 74 recovers the normally charged toner NT recovered by the recovery operation of the brush roller 73 from the brush roller 73.

Like the recovery blade 65, the recovery blade 75 is a metallic plate facing the recovery roller 74. A distal end of the recovery blade 75 is in contact with the recovery roller 74. Thus, the normally charged toner NT recovered by the recovery roller 74 is scraped off from the outer peripheral surface of the recovery roller 74 to be removed.

The power source 76 (second power source) applies a bias required for recovering the normally charged toner NT. As shown in FIG. 2, the power source 76 has one end grounded and the other end electrically coupled to the recovery roller 74 so as to provide a positive potential to the recovery roller 74.

As shown in FIG. 2, the driven roller 23 is grounded, and the intermediate transfer belt 21 is wound therearound. The intermediate transfer belt 21 and the brush roller 73 are in contact with each other at a contact position CP2. The brush roller 73 and the recovery roller 74 are in contact with each other for the recovery of the normally charged toner NT.

Accordingly, a positive second voltage having the polarity opposite from that of the first voltage is applied between the brush roller 73 and the intermediate transfer belt 21, and thus the normally charged toner NT is removed by the brush roller 73. The voltage to be applied by the power source 76 is controlled by the controller 90.

As described above, the negative voltage is applied between the brush roller 63 and the intermediate transfer belt 21 and the positive voltage is applied between the brush roller 73 and intermediate transfer belt 21. Thus, the cleaning unit 60 can efficiently remove the normally charged toner NT and the oppositely charged toner RT from the intermediate transfer belt 21.

In the embodiment, a length L1 (see FIG. 3) of the brush fiber 63*d* is preferably equal to or longer than 2 mm and equal to or shorter than 6 mm. Thus, the toner RT and the toner NT in the brushes 63*b* are uniformly distributed along the axial directions of the brush rollers 63 and 73. As long as the appropriate amounts of the toner RT and the toner NT are accumulated in the brushes 63*b*, the brushes 63*b* can perform uniform removing operations over the entire brush rollers 63 and 73 in the axial directions. Thus, excellent cleaning performance can be maintained.

In this embodiment, the winding angle θ1 of the brush 63*b* with respect to the rotational shaft 63*a* is preferably equal to or larger than 30 degrees and equal to or smaller than 80 degrees. Thus, the brush fibers 63*d* can be prevented from being excessively less densely arranged in the seam 63*e* than in the other portions, and the adherence of the brush 63*b* to the rotational shaft 63*a* can be improved. Thus, the cleaning failure attributable to the seam 63*e* can be prevented.

For example, with the winding angle θ1 being equal to or smaller than 80 degrees, the brush fibers 63*d* can be prevented from being arranged at excessively low density at a certain portion along the outer peripheries of the brush rollers 63 and 73. With the winding angle θ1 being equal to or larger than 30 degrees, the adherence of the brush 63*b* to the rotational shaft 63*a* can be improved. Thus, the brush 63*b* can be easily wound around the rotational shaft 63*a*.

In this embodiment, the intermediate transfer belt 21 is configured to move in the direction opposite from the rotational direction of the brush rollers 63 and 73 at the contact positions CP1 and CP2 as shown in FIG. 2. Thus, the scraping performances of the brush rollers 63 and 73 can be improved. Accordingly, the cleaning performance of the cleaning unit 60 can be improved.

In the embodiment, the speed ratio between the rotational speed of the driving roller 22 and the driven roller 23 that rotate the intermediate transfer belt 21 and the rotational speed of the brush rollers 63 and 73 is equal to larger than 0.5 and equal to or smaller than 3.5. Thus, the brush rollers 63 and 73 can efficiently remove the toner NT and the toner RT on the intermediate transfer belt 21.

For example, with the speed ratio being equal to or larger than 0.5, the brush rollers 63 and 73 can favorably remove the toner NT and the toner RT from the intermediate transfer belt 21. With the speed ratio being equal to or smaller than 3.5, the toner captured by the brush rollers 63 and 73 can be prevented from scattering from the brush rollers 63 and 73.

1.3. Advantage of the Image Forming Apparatus of the First Embodiment

As described above, the brush rollers 63 and 73 of the first embodiment face the intermediate transfer belt 21 with the winding directions of the brushes 63*b* being opposite form each other. The brush rollers 63 and 73 rotate in the same direction (indicated by the arrow AR2).

Thus, the seams 63*e* of the brush rollers 63 and 73 can be prevented from being in contact with the same portion on the image formation surface 21*a* of the intermediate transfer belt 21. Accordingly, even when the brush rollers 63 and 73 are used for a long period of time, the attached substances such as the toner RT and NT can be uniformly removed from the image formation surface 21*a* of the intermediate transfer belt 21, and thus the production of the image noise can be prevented.

2. Second Embodiment

A second embodiment of the present invention will be described below. An image forming apparatus 100 of the second embodiment has the same hardware configuration as the image forming apparatus 1 of the first embodiment, except that a plurality of lubricant suppliers 168 and 178 are provided. Thus, the difference is mainly described below.

Components common in the image forming apparatuses 1 and 100 are denoted with the same reference numerals. The components given the same reference numerals are described in the first embodiment and thus will not be described in this embodiment.

2.1. Configuration of Cleaning Unit

Figure 7:
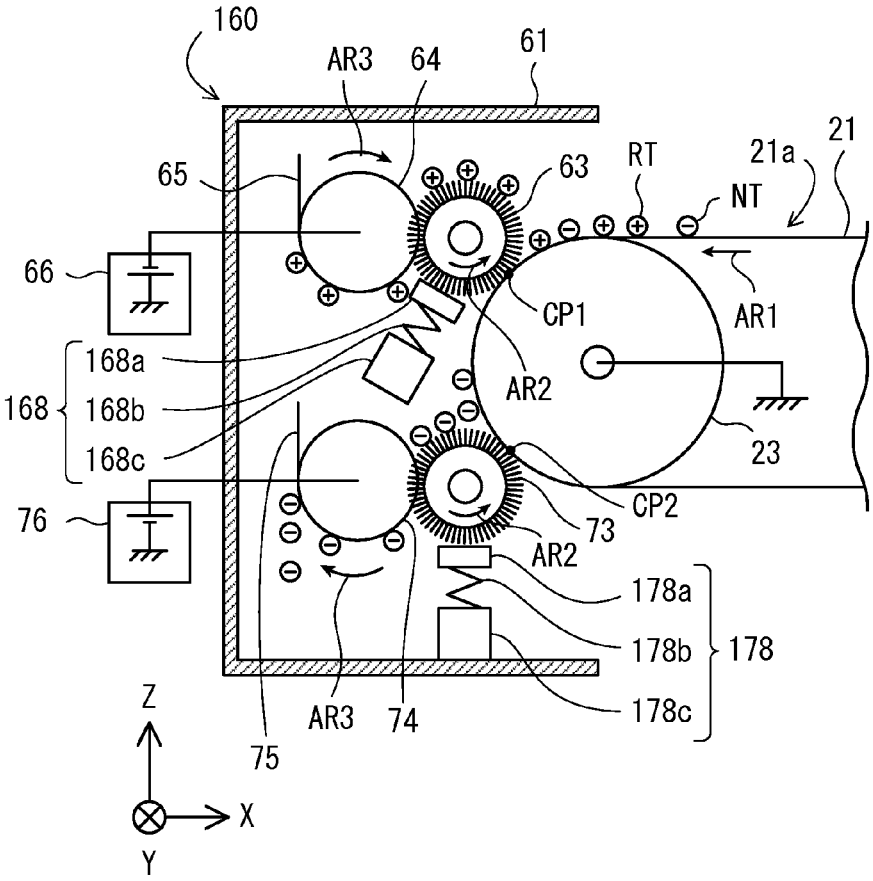
FIG. 7 is a front view showing an example of a configuration of a cleaning unit of the second embodiment.

FIG. 7 is a front view of showing an example of a configuration of a cleaning unit 160 of the second embodiment. Like the cleaning unit 60 of the first embodiment, the cleaning unit 160 removes the remaining toner on the intermediate transfer belt 21 after the toner image is transferred onto the recording medium P from the intermediate transfer belt 21. As shown in FIG. 7, the cleaning unit 160 mainly includes the brush rollers 63 and 73 and lubricant suppliers 168 and 178, which are incorporated in the frame body 61.

The lubricant supplier 168 is configured to be in contact with the outer periphery of the brush roller 63 to supply a lubricant to the brush roller 63. As shown in FIG. 7, the lubricant supplier 168 mainly includes a lubricant 168*a* and a biasing unit 168*b*.

The lubricant 168*a* is used for reducing the friction between the image formation surface 21*a* of the intermediate transfer belt 21 and the toner RT and NT. As shown in FIG. 7, the lubricant 168*a* is provided at a portion more on the downstream side than the recovery roller 64 in the rotational direction of the brush roller 63.

The biasing unit 168*b* is attached to an attachment portion 168*c* and biases the lubricant 168*a* against the brush roller 63. With the biasing force of the biasing unit 168*b*, the lubricant 168*a* is scraped off and thus supplied to the brush roller 63.

At the contact position CP1, the rotational direction of the brush roller 63 is opposite to the movement direction of the intermediate transfer belt 21. Thus, the lubricant 168*a* is supplied to the brush roller 63 from which the oppositely charged toner RT has been recovered by the recovery roller 64. Thus, the brush roller 63 can favorably apply the lubricant 168*a* on the image formation surface 21*a* of the intermediate transfer belt 21.

The lubricant supplier 178 is configured to be in contact with the outer periphery of the brush roller 73 to supply the lubricant to the brush roller 73. As shown in FIG. 7, the lubricant supplier 178 mainly includes a lubricant 178*a* and a biasing unit 178*b*.

Like the lubricant 168*a*, the lubricant 178*a* is used for reducing the friction between the image formation surface 21*a* of the intermediate transfer belt 21 and the toner RT and NT. As shown in FIG. 7, the lubricant 178*a* is provided at a portion more on the downstream side than the recovery roller 74 in the rotational direction of the brush roller 73.

The biasing unit 178*b* is attached to an attachment portion 178*c* and biases the lubricant 178*a* against the brush roller 73. With the biasing force of the biasing unit 178*b*, the lubricant 178*a* is scraped off and thus supplied to the brush roller 73.

At the contact position CP2, the rotational direction of the brush roller 73 is opposite to the movement direction of the intermediate transfer belt 21. Thus, the lubricant 178*a* is supplied to the brush roller 73 from which the normally charged toner NT has been recovered by the recovery roller 74. Thus, the brush roller 73 can favorably apply the lubricant 178*a* on the image formation surface 21*a* of the intermediate transfer belt 21.

2.2. Advantage of the Image Forming Apparatus of the Second Embodiment

As described above, the brush rollers 63 and 73 of the second embodiment face the intermediate transfer belt 21 with the winding directions of the brushes 63*b* being opposite form each other. The brush rollers 63 and 73 rotate in the same direction (indicated by the arrow AR2). Accordingly, even when the brush rollers 63 and 73 are used for a long period of time, the attached substances such as the toner RT and NT can be uniformly removed from the image formation surface 21*a* of the intermediate transfer belt 21, and thus the production of the image noise can be prevented.

The image forming apparatus 100 of the second embodiment can supply the lubricants 168*a* and 178*a* respectively to the brush rollers 63 and 73. Thus, the brush rollers 63 and 73 serve not only as the removing rollers for removing the toner RT and NT but also as lubricant applying rollers for applying the lubricants 168*a* and 178*a* on the intermediate transfer belt 21.

3. Third Embodiment

Next, a third embodiment of the present invention will be described below. An image forming apparatus 200 of the third embodiment has the same hardware configuration as the image forming apparatus 100 of the second embodiment, except that a removing blade 279 is provided. Thus, the difference is mainly described below.

Components common in the image forming apparatuses 100 and 200 are denoted with the same reference numerals. The components given the same reference numerals are described in the second embodiment and thus will not be described in this embodiment.

Figure 8:
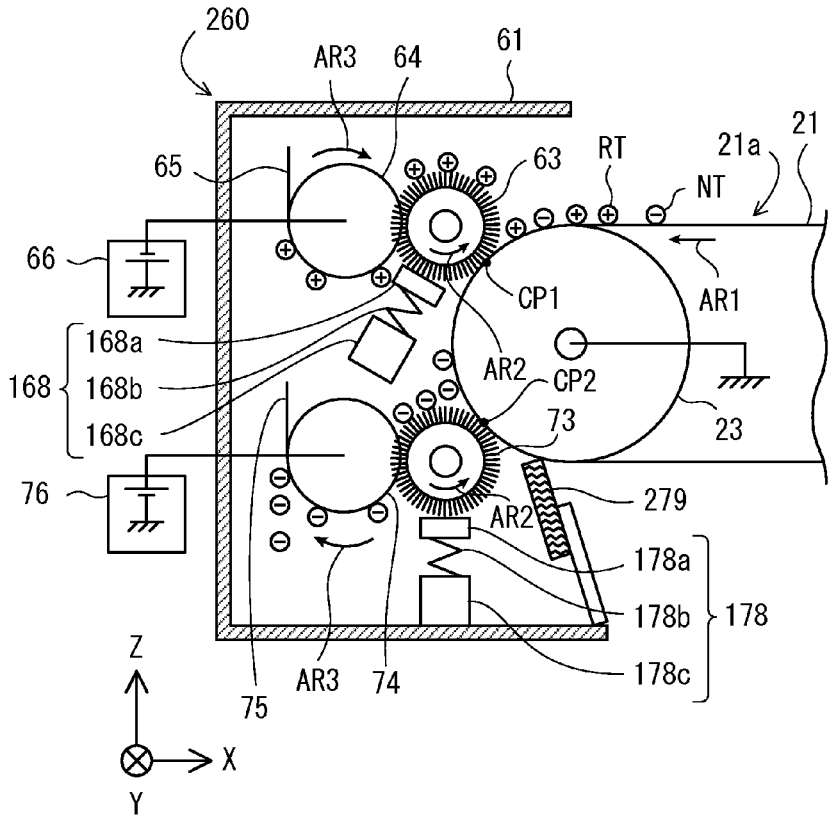
FIG. 8 is a front view showing an example of a configuration of a cleaning unit of the third embodiment.

FIG. 8 is a front view of showing an example of a configuration of a cleaning unit 260 of the third embodiment. Like the cleaning unit 160 of the second embodiment, the cleaning unit 260 removes the remaining toner on the intermediate transfer belt 21 after the toner image is transferred onto the recording medium P from the intermediate transfer belt 21. As shown in FIG. 8, the cleaning unit 260 mainly includes the brush rollers 63 and 73, the lubricant suppliers 168 and 178, and the removing blade 279, which are incorporated in the frame body 61.

Like the recovery blade 65, the removing blade 279 is a metallic plate. As shown in FIG. 8, the removing blade 279 is disposed more on the downstream side than the brush rollers 63 and 73 in the movement direction of the intermediate transfer belt 21. A distal end of the removing blade 279 is in contact with the intermediate transfer belt 21. Thus, the toner RT and NT are scraped off from the image forming surface 21*a* of the intermediate transfer belt 21 to be removed.

As described above, the lubricant suppliers 168 and 178 supply the lubricants 168*a* and 178*a* respectively to the brush rollers 63 and 73. Thus, the lubricants 168*a* and 178*a* are applied on the intermediate transfer belt 21 at a portion more on the upstream side than the removing blade 279 in the movement direction. Accordingly, the friction between the removing blade 279 and the intermediate transfer belt 21 can be reduced by the lubricants 168*a* and 178*a*. Thus, the intermediate transfer belt 21 can be prevented from having the attached substances thereon due to the friction between the removing blade 279 and the intermediate transfer belt 21.

4. Modifications

The present invention is not limited to the embodiments described above, and can be modified in various ways.

(1) In the first to the third embodiments, the cleaning units 60, 160, and 260 remove the toner from the intermediate transfer belt 21. The toner removal target is not limited to the intermediate transfer belt 21 and the photoreceptor drum used as an image carrier may be the toner removal target of the cleaning units 60, 160, and 260 for example.

(2) In the first to the third embodiments, voltages of opposite polarities are respectively applied to the brush rollers 63 and 73. Alternatively, voltages of the same polarity may be applied to the brush rollers 63 and 73

(3) In the second and third embodiments, the lubricant suppliers 168 and 178 are in contact with respectively the outer peripheries of the brush rollers 63 and 73. However, the present invention is not limited to this configuration. For example, in the cleaning units 160 and 260, only the lubricant supplier 168 may be in contact with the corresponding brush roller 63.

Specifically, the lubricant is only required to be supplied to at least one of the brush rollers 63 and 73 with the outer periphery of the roller being in contact with the single lubricant supplier.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

an image carrier configured to move an image formation surface on which a toner image is formed, along a movement direction;

a first brush roller configured to rotate in a rotational direction while being in contact with the image formation surface to remove toner from the image carrier; and a second brush roller disposed in parallel with the first brush roller and configured to rotate in the rotational direction while being in contact with the image formation surface to recover the toner from the image carrier, wherein the first and the second brush rollers each comprise a brush formed by planting a plurality of brush fibers in a base portion extending in a single direction, and a rotational shaft having an outer periphery around which the brush is helically wound, wherein the first and the second brush rollers face the image carrier with brush winding directions being opposite from each other.

2. The image forming apparatus according to claim 1, wherein a length of each of the brush fibers is equal to or longer than 2 mm and equal to or shorter than 6 mm.

3. The image forming apparatus according to claim 1, wherein a winding angle of the brush with respect to the rotational shaft is equal to or larger than 30 degrees and equal to or smaller than 80 degrees.

4. The image forming apparatus according to claim 1, wherein, at contact positions between the image carrier and the first and the second brush rollers, the movement direction of the image carrier is opposite to the rotational direction of the first and the second brush rollers.

5. The image forming apparatus according to claim 1, wherein rotational speeds of the first and the second brush rollers are the same.

6. The image forming apparatus according to claim 1, wherein the image carrier comprises a rotator configured to move the image formation surface, and wherein a speed ratio between a rotational speed of the rotator of the image carrier and the rotational speed of the first and the second brush rollers is equal to or larger than 0.5 and equal to or smaller than 3.5.

7. The image forming apparatus according to claim 1 further comprising:

a first power source configured to apply a first voltage between the first brush roller and the image carrier to make the first brush roller remove oppositely charged toner; and a second power source configured to apply a second voltage having a polarity opposite from a polarity of the first voltage between the second brush roller and the image carrier to make the second brush roller remove normally charged toner, wherein the first brush roller is disposed more on an upstream side than the second brush roller in the movement direction.

8. The image forming apparatus according to claim 7 further comprising a lubricant supplier configured to be in contact with an outer periphery of at least one of the first and the second brush rollers to supply a lubricant to the at least one of the first and the second brush rollers.

9. The image forming apparatus according to claim 7 further comprising a removing blade disposed more on a downstream side than the first and the second brush rollers in the movement direction, and configured to remove the toner from the image formation surface of the image carrier.

* * * * *